US007056023B2

(12) United States Patent
Heidel

(10) Patent No.: US 7,056,023 B2
(45) Date of Patent: Jun. 6, 2006

(54) WASH BAG ASSEMBLY

(75) Inventor: Lena L. Heidel, Dunwoody, GA (US)

(73) Assignee: The Evercare Company, Alpharetta, GA (US)

( * ) Notice: Subject to any disclaimer, the term of this patent is extended or adjusted under 35 U.S.C. 154(b) by 155 days.

(21) Appl. No.: 10/787,293

(22) Filed: Feb. 26, 2004

(65) Prior Publication Data

US 2005/0196075 A1 Sep. 8, 2005

(51) Int. Cl.
*B65D 30/06* (2006.01)

(52) U.S. Cl. ..... 383/117; 383/86; 383/97; 383/102; 383/109

(58) Field of Classification Search ..... 383/117, 383/97, 86, 109, 102
See application file for complete search history.

(56) References Cited

U.S. PATENT DOCUMENTS

| | | | | |
|---|---|---|---|---|
| 2,443,695 | A | 6/1948 | Russell | |
| 2,446,234 | A | 8/1948 | Lieber | |
| 2,497,325 | A | 2/1950 | Scherba | 150/52 |
| 2,628,432 | A | 2/1953 | Morrison | |
| 3,036,616 | A * | 5/1962 | Allen | 383/39 |
| 3,256,616 | A | 6/1966 | McGoldrick | |
| 3,287,820 | A | 11/1966 | Gibson | |
| 3,316,659 | A | 5/1967 | Lauck | |
| 3,344,532 | A | 10/1967 | Bigler | |
| 3,372,724 | A | 3/1968 | Rouse | |
| 3,422,867 | A * | 1/1969 | Wu | 383/66 |
| 3,706,210 | A | 12/1972 | Gendron | |
| 3,724,095 | A | 4/1973 | Laue et al. | |
| 4,091,548 | A | 5/1978 | Daily | |
| 4,109,397 | A | 8/1978 | Daily | |
| D265,523 | S | 7/1982 | Mermer | |

(Continued)

FOREIGN PATENT DOCUMENTS

| | | |
|---|---|---|
| GB | 867107 | 5/1961 |
| JP | 06312084 | 11/1994 |
| JP | 09182890 | 7/1997 |
| JP | 11070291 | 3/1999 |
| JP | 2000102692 | 4/2000 |

(Continued)

*Primary Examiner*—Jes F. Pascua
(74) *Attorney, Agent, or Firm*—Gifford, Krass, Groh, Sprinkle, Anderson & Citkowski, P.C.

(57) ABSTRACT

A wash bag assembly for washing delicate wash items having a container which defines an interior chamber. The container is constructed of a water-permeable material. A separator wall extends through the interior chamber and divides the interior chamber into a first and second sub-chamber. A first closure selectively provides access to the first subchamber for the insertion and removal of at least one wash item while, similarly, a second closure selectively provides access into the second subchamber for the insertion and removal of at least one wash item.

10 Claims, 2 Drawing Sheets

U.S. PATENT DOCUMENTS

| | | | | |
|---|---|---|---|---|
| 4,388,739 | A * | 6/1983 | Martinon et al. | 8/150 |
| 4,503,559 | A | 3/1985 | Warnke | 383/40 |
| 4,530,168 | A | 7/1985 | Petre | |
| 4,677,760 | A | 7/1987 | St. Louis | |
| 4,702,016 | A | 10/1987 | Grigsby et al. | |
| 4,813,641 | A | 3/1989 | Wilson | |
| D335,008 | S | 4/1993 | Abel | |
| 5,211,689 | A | 5/1993 | Kobayashi | |
| 5,320,429 | A | 6/1994 | Toyosawa | |
| 5,992,045 | A | 11/1999 | Kellogg et al. | |
| 6,234,368 | B1 | 5/2001 | DesForges et al. | |
| 6,726,362 | B1 | 4/2004 | Frisch et al. | 383/103 |
| 2003/0054717 | A1 | 3/2003 | Ahluwalia | |
| 2003/0059133 | A1 | 3/2003 | Hsieh | |

FOREIGN PATENT DOCUMENTS

| | | |
|---|---|---|
| JP | 2000254386 | 9/2000 |
| JP | 2001062184 | 3/2001 |
| JP | 2001070688 | 3/2001 |
| JP | 2001104684 | 4/2001 |
| JP | 2001120884 | 5/2001 |
| JP | 2002018181 | 1/2002 |

* cited by examiner

WASH BAG ASSEMBLY

BACKGROUND OF THE INVENTION

I. Field of the Invention

The present invention relates generally to a wash bag assembly for delicate wash items.

II. Description of Related Art

Delicate garments and clothes, such as bras, panties and the like, are usually stretched, worn or torn during repeated washing with other clothes. In order to protect such delicate garments during the washing process, there have been previously known wash bags into which the delicate garments were inserted and then the wash bag is placed in the washing machine with the other clothes.

These previously known wash bags typically comprise a mesh material which allows the water and soap to enter into the interior of the wash bag in order to cleanse the delicate garments and yet simultaneously protect the delicate garments from other clothes during the washing operation. These previously known wash bags, however, have not proven wholly satisfactory in use.

One disadvantage of these previously known wash bags is that the wash bags used a relatively large mesh as the material for the wash bag. As such, these relatively large mesh materials allowed debris, lint and other objects to enter into the interior of the bag during the washing operation. Such other debris and material may not only damage the delicate wash items contained within the interior of the wash bag, but also lint that travels into the interior of the bag accumulates on the delicate wash items.

A still further disadvantage of these previously known wash bags is that such wash bags are designed to contain a single delicate garment, such as a single bra. Consequently, when it is necessary to wash more than one delicate garment, it is necessary to either (1) insert multiple wash bags into the washing machine or (2) insert two or more wash items into the single bag even though the single wash bag was designed to only contain a single wash item. In the latter case, the wash items contained within the wash bag may not be adequately cleaned during the washing operation. Additionally, when multiple wash items are contained within the wash bag, they can become tangled and possibly damaged during the washing operation.

SUMMARY OF THE PRESENT INVENTION

The present invention provides a wash bag assembly which overcomes all of the above-mentioned disadvantages of the previously known wash bags.

In brief, the wash bag assembly of the present invention comprises a container defining an interior chamber. The container is constructed of a water-permeable material and is preferably constructed of a knitted mesh material.

A separator wall extends through the interior chamber and divides the interior chamber into a first and second subchamber. A first closure, such as a zipper, selectively provides access into the first subchamber of the container for the insertion of a wash item. Similarly, a second closure, such as a zipper, selectively provides access into the second subchamber of the container in order to contain a second wash item.

Preferably the mesh material includes an inner layer and an outer layer which are attached together by connecting fibers. The inner layer has openings of a first predetermined size and, similarly, the outer layer has openings of a second predetermined size. The openings on the inner layer, however, are much larger in cross-sectional area than the openings on the outer layer to allow the free flow of water and soap through the inner layer. Conversely, the smaller cross-sectional area of the openings on the outer layer are dimensioned to prevent, or at least minimize, the passage of lint through the outer layer thus protecting the wash items contained within the interior of the container from lint and similar detritus.

In a modification of the invention, the wash bag includes a generally rectangular bag made of a mesh material. The top and bottom of the bag are pleated such that the bag can expand to accommodate larger articles, such as sweaters. Additionally, a zipper or other closure is attached to the container to provide access into the interior of the container for the insertion and removal of one or more wash items into the interior of the bag. A flap also extends over the zipper in order to protect clothing from the zipper during a washing operation.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
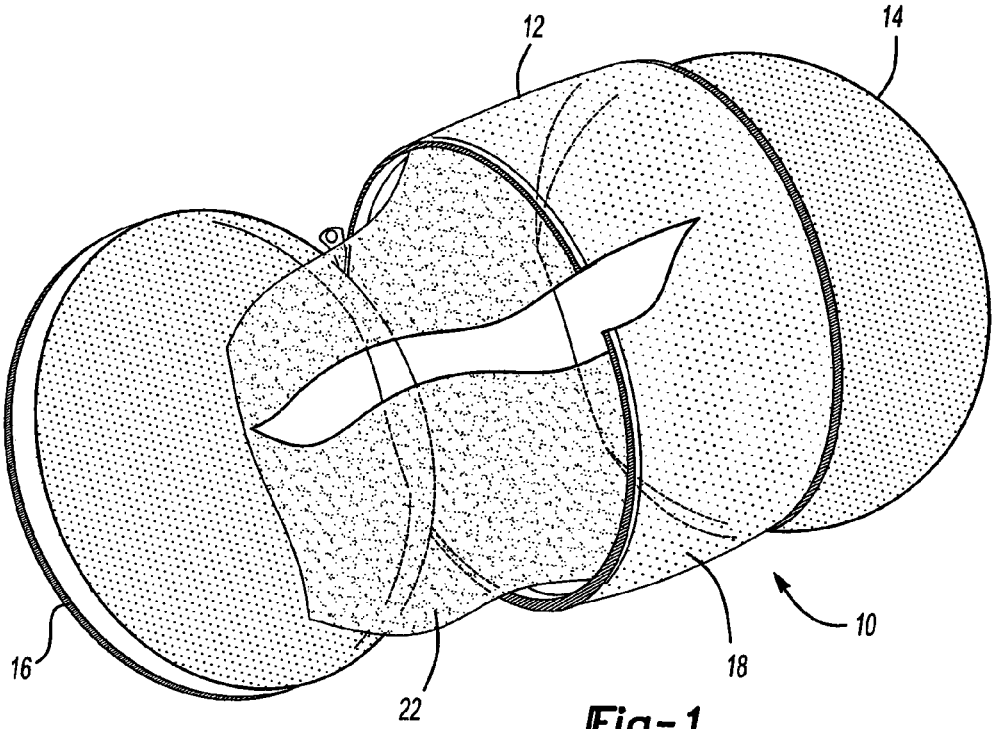
FIG. 1 is an elevational view illustrating a preferred embodiment of the present invention.
Figure 2:
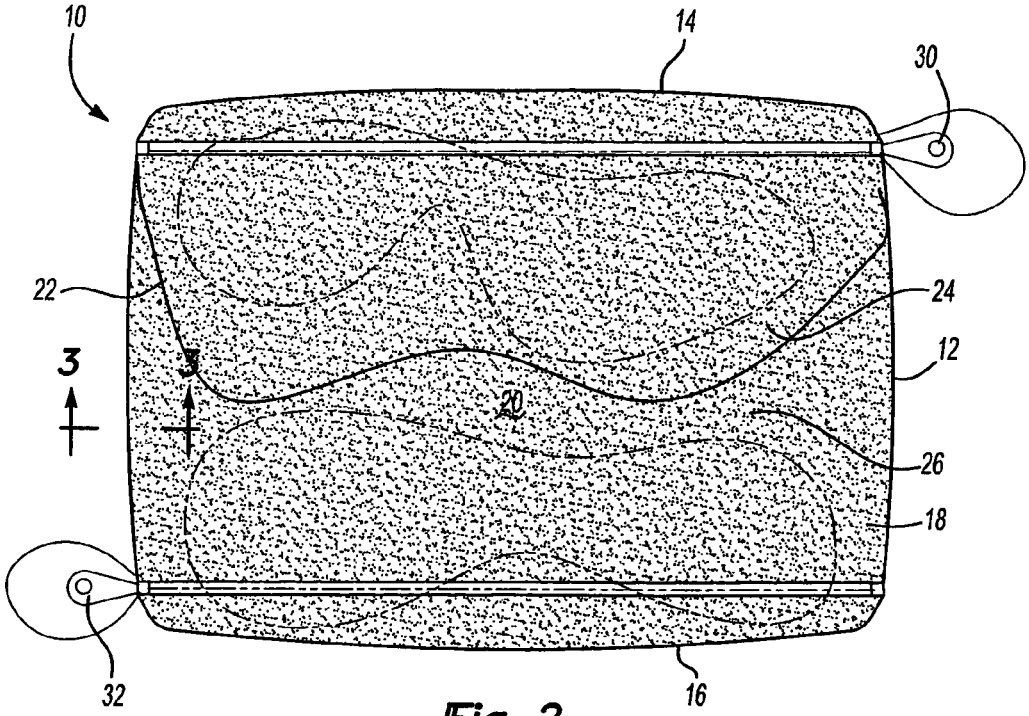
FIG. 2 is a front view of the preferred embodiment of the invention.

With reference first to FIGS. 1 and 2, a preferred embodiment of the wash bag assembly 10 of the present invention is illustrated. The wash bag assembly 10 includes a container 12 which is generally cylindrical in shape, thus having a top 14, a bottom 16 and an outer cylindrical side wall 18. Consequently, the top 14, bottom 16 and side wall 18 together define an interior chamber 20.

As best shown in FIG. 2, a separator wall 22 extends through the interior chamber 20 of the container 12 and divides the interior chamber 20 into two subchambers 24 and 26. The subchambers 24 and 26 are illustrated in FIG. 1 as being substantially of equal volume. However, in practice, the subchambers 24 and 26 may be of either the same size, or one may be larger than the other.

The separator wall 20 is constructed of a water permeable material so that water may freely flow through the separator wall 22. Preferably, the separator wall 22 comprises a knitted mesh material made of a synthetic material, such as nylon or polyester, and is preferably the same material as the side wall 18.

A first closure 30, preferably a zipper, selectively provides access into the first subchamber 24 to allow the insertion and removal of wash items, such as bras and other delicate items, into the subchamber 24. Similarly, a second closure 32 selectively provides access to the second subchamber 26 for the insertion of wash items into the subchamber 26 as well as removal of those wash items from the subchamber 26 after a washing cycle.

Figures 3, 4, 5:
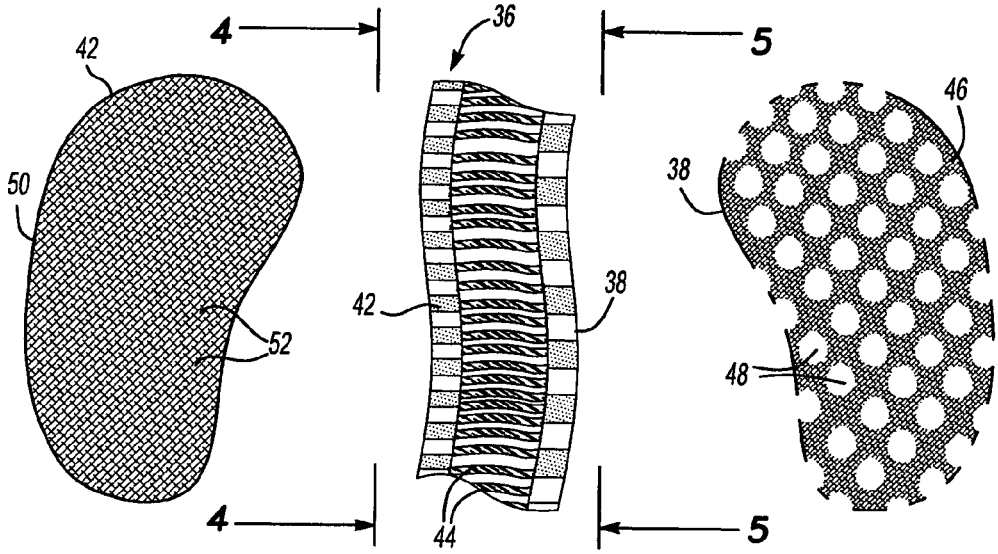
FIG. 3 is a fragmentary view taken substantially along line 3—3 in FIG. 2 and enlarged for clarity.
FIG. 4 is a view taken along line 4—4 in FIG. 3.
FIG. 5 is a view taken along line 5—5 in FIG. 3.

With reference now to FIG. 3, the top 14, bottom 16 and side wall 18 of the container 12 are each constructed of a water-permeable material. Preferably, the water-permeable material comprises a mesh material 36 having both an inner mesh layer 38 and an outer mesh layer 42. The inner layer 38 faces the interior subchambers 24 and 26 while, conversely, the outer layer 42 faces outwardly from the container 12. A plurality of connecting fibers 44 extend between the inner layer 38 and outer layer 42 to secure the inner layer 38 and outer layer 42 together.

With reference now particularly to FIGS. 3 and 5, the inner layer 38 preferably comprises a knitted mesh 46 having a plurality of openings 48 of a predetermined cross-sectional area. The openings 48 are preferably oval in shape with a long dimension of 0.1 inch and a short dimension of 0.08 inch. Additionally, the openings 48 have a cross-sectional area sufficiently small so that hooks on wash items cannot engage the inner layer 38. The knitted mesh 46 may be constructed of any suitable material, but preferably is constructed from a synthetic material, such as nylon or polyester. Alternatively, however, the inner layer 38 may be constructed of any type of fabric, such as woven, non-woven, braided and tufted fabric although knitted fabric is preferred. Preferably, the knitted fabric can be a weft knit or a warp knit structure.

With reference now particularly to FIGS. 3 and 4, the outer layer 42 also comprises a mesh material 50 having a plurality of predetermined openings 52 of a predetermined cross-sectional area. The cross-sectional area of the openings 52, however, is smaller than the openings 48 in the inner layer 38. Additionally, the size of the openings 52 in the outer layer 42 is sufficiently small to prevent or at least minimize the passage of lint, fibers and other detritus through the outer layer 42.

Like the inner layer 38, the outer layer 42 can be made of any type of fabric, such as woven, non-woven, braided, tufted fabric and the like, but is preferably a knitted fabric. If knitted, the knitted fabric may be either a weft knit or a warp knit structure, or a combination of a warp knit and weft knit. Preferably, a warp knit fabric is used for the outer layer 42.

The inner layer 38 has an air permeability of at least 825 cubic feet per minute. Similarly, the outer layer 42 has an air permeability of at least 800 cubic feet per minute while the mesh material 36 has a combined air permeability of greater than 750 cubic feet per minute. In practice, such permeability has been found to allow adequate soap and water to enter into the subchambers 24 and 26, thus cleansing the wash items contained within the subchambers during a wash cycle, as well as enabling the free outflow of water while simultaneously preventing the entry of lint and other debris and detritus into the interior of the subchambers 24 and 26 or between the layers 38 and 42.

In practice, one or more wash items are placed into each of the subchambers 24 and 26 of the container 12. Thereafter, the closures 30 and 32 are closed thus entrapping the delicate wash items within the interior of the container 12. The container 12 is then placed within the washing machine and washed either by itself, or along with other items to be cleaned.

During the washing operation, the wash bag assembly 10 allows the free flow of water into the interior of the container 12 thus washing the items contained within the interior of the chamber 12. Simultaneously, the wash container 12 protects the delicate wash items within the container 12 from damage caused by rubbing and/or impacting against other garments contained within the washing machine as well as the washing machine itself during the wash cycle.

Figure 6:
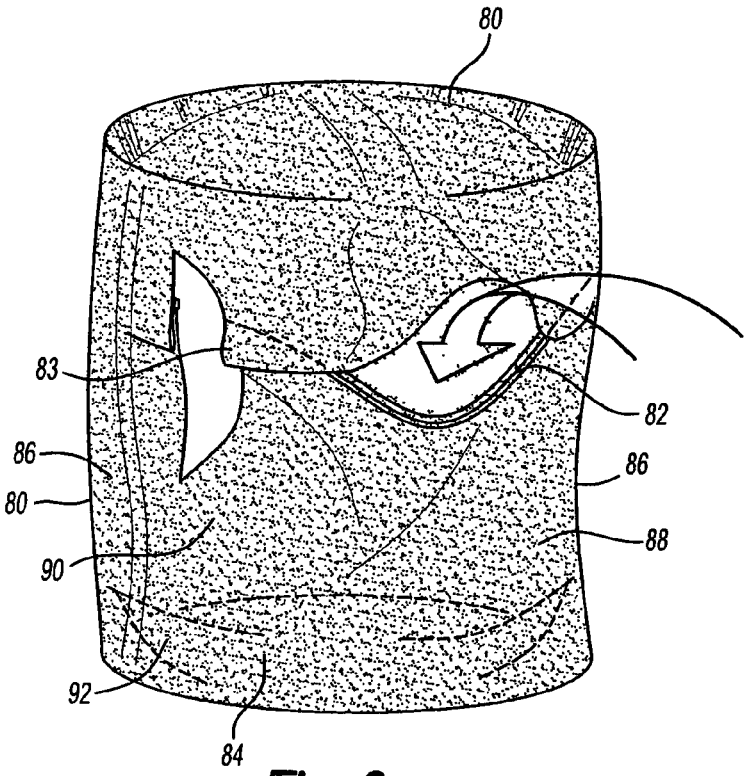
FIG. 6 is an elevational view illustrating a second preferred embodiment of the present invention.

With reference now to FIG. 6, a second embodiment of the present invention is illustrated and comprises a wash bag 80 constructed of a water-permeable material, such as a knitted mesh. Furthermore, the size of the openings in the knitted mesh is preferably small enough to prevent or at least minimize the entry of lint and other debris into the interior of the bag 80. Additionally, the wash bag 80 has an air permeability of greater than 800 CFM.

A closure 82, such as a zipper, is provided on the bag 80 in order to provide access into the interior of the bag. Additionally, a flap 83 overlies the closure 82 to protect other garments from the closure 82 during a washing operation.

The wash bag 80 is generally rectangular in shape thus having a top 86, a bottom 84, spaced-apart sides 86, a front 88 and a back 90. Additionally, both the top 86 and bottom 84 include pleats 92 to allow the bag 80 to expand in size. Consequently, the bag 80 is expandable to accommodate bulkier items, such as sweaters.

From the foregoing, it can be seen that the present invention provides a wash bag assembly which efficiently and effectively protects delicate wash items, such as bras, lingerie and like, from damage during a washing operation. Having described my invention, however, many modifications thereto will become apparent to those skilled in the art to which it pertains without deviation from the spirit of the invention as defined by the scope of the appended claims.

I claim:

1. A wash bag assembly for wash items comprising:

a container defining an interior chamber, said container being constructed of a water-permeable material, a closure which selectively provides access into said interior chamber of said container for the insertion and removal of at least one wash item, wherein said water-permeable material comprises a mesh material having an outer layer and an inner layer, said inner layer having openings of a first size and said outer layer having openings of a second size, said first size being greater than said second size, and connecting fibers extending between and attached to said inner and outer layers of said mesh material.

2. The invention as defined in claim 1 wherein said second size of said outer layer openings is dimensioned to minimize the passage of lint.

3. The invention as defined in claim 1 wherein said mesh material comprises a synthetic material.

4. The invention as defined in claim 1 wherein said mesh material comprises a knitted material.

5. The invention as defined in claim 1 wherein said inner layer has an air permeability of greater than 825 cubic feet per minute.

6. The invention as defined in claim 1 wherein said outer layer has an air permeability of greater than 800 cubic feet per minute.

7. The invention as defined in claim 1 wherein said mesh material has an air permeability of greater than 750 cubic feet per minute.

8. The invention as defined in claim 1 wherein said closure comprises a zipper.

9. The invention as defined in claim 8 and comprising a flap secured to said container, said flap overlying said zipper.

10. The invention as defined in claim 1 wherein said container is cylindrical in shape.

* * * * *